United States Patent [19]

Pearl

[11] 4,033,214

[45] July 5, 1977

[54] BLADE SHARPENER

[75] Inventor: David Raymond Pearl, West Hartford, Conn.

[73] Assignee: Gerber Garment Technology, Inc., East Hartford, Conn.

[22] Filed: Jan. 12, 1976

[21] Appl. No.: 648,540

Related U.S. Application Data

[63] Continuation-in-part of Ser. No. 398,255, Sept. 17, 1973, Pat. No. 3,955,458.

[52] U.S. Cl. ..... 83/174; 51/247; 83/925 CC

[51] Int. Cl.² ..... B24B 3/36; B26D 7/12

[58] Field of Search ..... 83/174, 174.1, 925 CC; 51/90, 246, 247; 10/139

[56] References Cited

UNITED STATES PATENTS

| | | | |
|---|---|---|---|
| 927,689 | 7/1909 | Simon | 51/246 X |
| 3,507,177 | 4/1970 | Baldwin | 83/174 |

*Primary Examiner*—Othell M. Simpson
*Assistant Examiner*—Z. R. Bilinsky
*Attorney, Agent, or Firm*—McCormick, Paulding & Huber

[57] ABSTRACT

A cutting apparatus for cutting pattern pieces from layups having a low stack height employs a cutting head having a small reciprocating blade suspended from a carriage which moves over the layup. The drive motors for reciprocating the blade and orienting the blade in a particular cutting direction about a $\theta$-axis remain in a stationary position on the cutting head as the blade is oriented and elevated in and out of cutting contact with the layup. A blade sharpener is suspended from the head with the cutting blade and is energized by spinning the blade about the $\theta$-axis. Drilling is also accomplished by spinning the blade.

19 Claims, 13 Drawing Figures

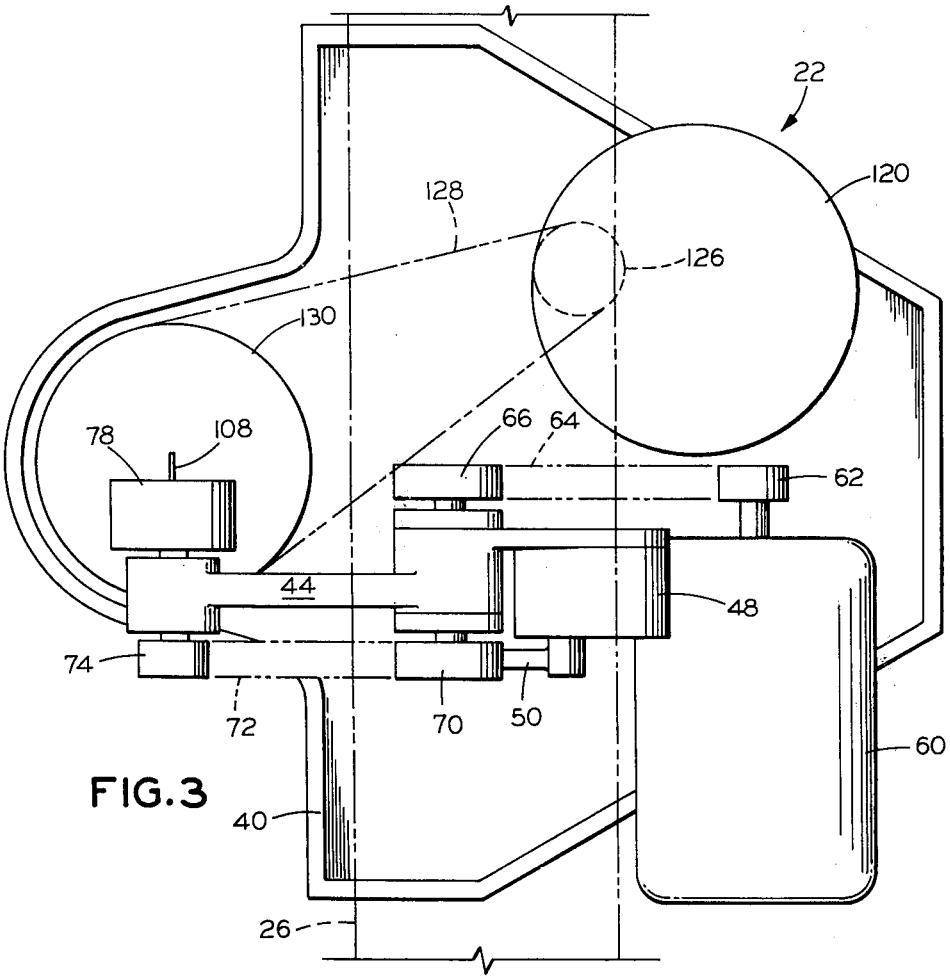
FIG. 3
FIG. 10
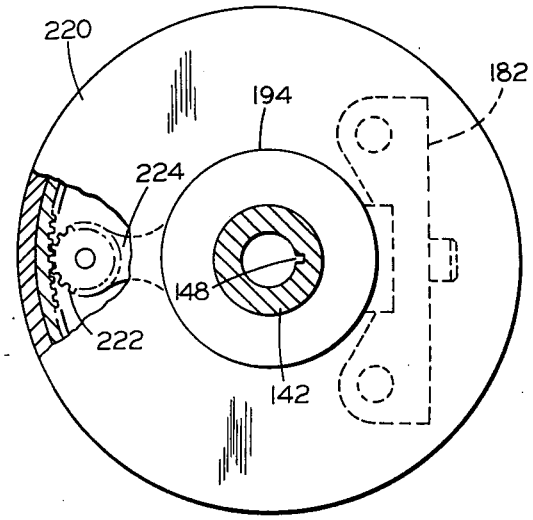
FIG. 11
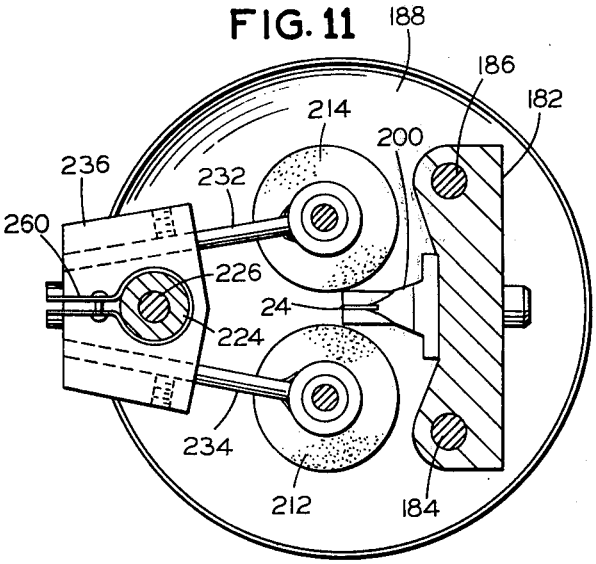

BLADE SHARPENER

CROSS REFERENCE TO RELATED APPLICATION

This application is a continuation-in-part of application Ser. No 398,255, filed Sept. 17, 1973 by the applicant now U.S. Pat. No. 3,955,458.

BACKGROUND OF THE INVENTION

The present invention relates to apparatus for cutting sheet material, and, more particularly, to a numerically controlled cutting apparatus suitable for cutting pattern pieces from fabric layups having a low stack height.

The use of numerically controlled cutting tools in the garment, automobile and other fabric-cutting industries is well established. Numerically controlled equipment is capable of cutting large quantities of pattern pieces from layups with as many as 150 plies of sheet material with high speed and accuracy. Cutting programs control the operation of a cutting tool, such as a reciprocating cutting blade, and cause it to translate through high or deep layups while the layups are held in a spread condition on a cutting table. Relative movement between the cutting blade and the layups can be produced by moving the cutting blade or the layup or both under program control.

U.S. Pat. No. 3,495,492 having the same assignee as the present invention discloses a prior art cutting apparatus in which the layup of sheet material is held in position on a vacuum table. The use of a vacuum hold-down technique assists the cutting operation by holding each ply of sheet material in the layup in position relative to the other plies and the cutting surface over which the operation takes place so that precise correspondence between patterns cut from the top and bottom plies results. While cutting machines such as disclosed in the above-referenced patent may be used in cutting layups of different depths or heights above the supporting surface of the cutting table, they are designed to withstand the maximum loads experienced while cutting deep layups of 6 inches or more. Correspondingly, their speed and agility in cutting layups of low stack height are somewhat limited.

Accordingly, it is a general object of the present invention to disclose a cutting head for use in cutting machines that operate upon layups of low stack height. The head is constructed with low translational and polar moments of inertia to operate efficiently in low-stack-height layups in response to a simplified cutting program.

SUMMARY OF THE INVENTION

The present invention resides in a blade sharpener for use on a cutting apparatus having a cutting blade which translates through spread sheet material in a cutting operation. The cutting blade is mounted on a platform positioned above a support surface on which the sheet material is held and is moved toward and away from the support surface to bring the cutting blade into or out of cutting engagement with the sheet material. In a preferred embodiment, the cutting blade is a reciprocating blade suspended from the platform for rotation about an axis perpendicular to the support surface. During a cutting operation, the blade is translated through the sheet material and is oriented about the perpendicular axis to remain tangent to the cutting path at each point. The means for orienting the cutting blade is also mounted on the tool platform.

The blade sharpener is suspended from the cutting platform with the cutting blade and is operated by selectively engageable drive means when the blade is spun about the perpendicular axis. The sharpener includes a sharpening wheel placed adjacent the cutting edge of the blade for rotation about the perpendicular axis with the blade.

The drive means has an output member connected with the sharpening wheel and when engaged, rotates the output member and the wheel in response to rotation of the blade about the perpendicular axis. In a preferred embodiment of the invention, the drive means comprises a planetary drive and a selectively operated locking means cooperating with a portion of the planetary drive to cause the output member to rotate simultaneously with the blade.

BRIEF DESCRIPTION OF THE DRAWINGS

FIG. 3 is a top plan view of the cutting head in FIG. 2.

FIG. 10 is a cross-sectional view of the blade sharpener as viewed along the sectioning line 10–10 in FIG. 7.

FIG. 11 is a cross-sectional view of the sharpener as viewed along the sectioning line 11—11 in FIG. 7.

DESCRIPTION OF THE PREFERRED EMBODIMENTS

Figure 1:
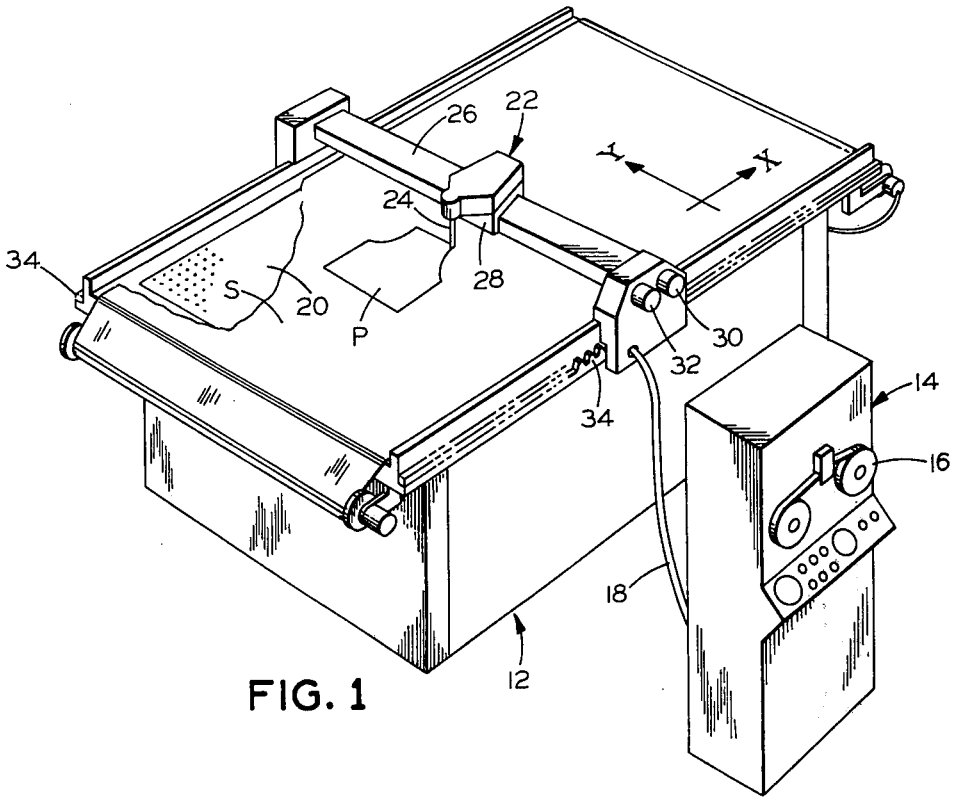
FIG. 1 is a perspective view of a cutting apparatus in which the present invention resides.

FIG. 1 illustrates a cutting apparatus, generally designated 10, in which the cutting head of the present invention is employed. The cutting apparatus is comprised of a cutting table 12 and a control computer 14 which controls the cutting table 12 and a control computer 14 which controls the operation of the table 12 in accordance with a cutting program defined on a program tape 16. Commands from the computer 14 are transmitted to the table through a cable 18 and information from the table is also fed back to the controller through the cable in the course of a cutting operation.

The cutting table 12 has a penetrable support surface 20 on which sheet material S is laid in a spread condition. The material may be supported in rolls at the opposite longitudinal ends of the table for spreading in either single or multi-ply layups on the surface. A cutting head 22 including a reciprocating cutting blade 24 is mounted above the support surface 20 by means of an X-carriage 26 which traverses the cutting table 12 on ways in the illustrated X-direction and a Y-carriage 28 which is mounted on the X-carriage and translates on ways relative to the X-carriage and the table in the illustrated Y-direction. An X-drive motor 30 mounted on the carriage 26 has pinions (not shown) engaging gear racks 34 at the opposite sides of the table 12 and is controlled by the computer 14 in accordance with the cutting program. A Y-drive motor 32 also mounted on the carriage 26 engages the Y-carriage 28 by means of a lead screw (not shown) or equivalent drive means such as a toothed-belt-and-pulley system, and is controlled by the computer 14 in accordance with the cutting program.

Combined motions of the carriages 26 and 28 permit the blade 24 to be translated over the surface 20 of the table in cutting engagement with the sheet material S. The controlled motions of the carriages and the blade 24 allow pattern pieces, such as the piece P, to be cut from the sheet material. Ordinarily, a marker identifying an array of pattern pieces in closely spaced relationship is cut from the sheet material rather than the single pattern piece P illustrated.

To permit the blade 24 to completely penetrate the sheet material along the entire periphery of the pattern piece P, the bed of the table defining the support surface 20 is preferably a penetrable bed formed by blocks of foamed plastic or bristled mats. A vacuum system associated with the penetrable bed holds the material tightly against the surface 20 and prevents the material from shifting on the surface as the cutting operation progresses. If the material forming the layup is air-pervious, it may be desirable to position an overlay of air-impervious material, such as a sheet of polyethylene on the sheet material to assist the holddown operation. A penetrable cutting table having a vacuum holddown system of this type is disclosed in U.S. Pat. No. 3,495,492 referenced above.

Figure 4:
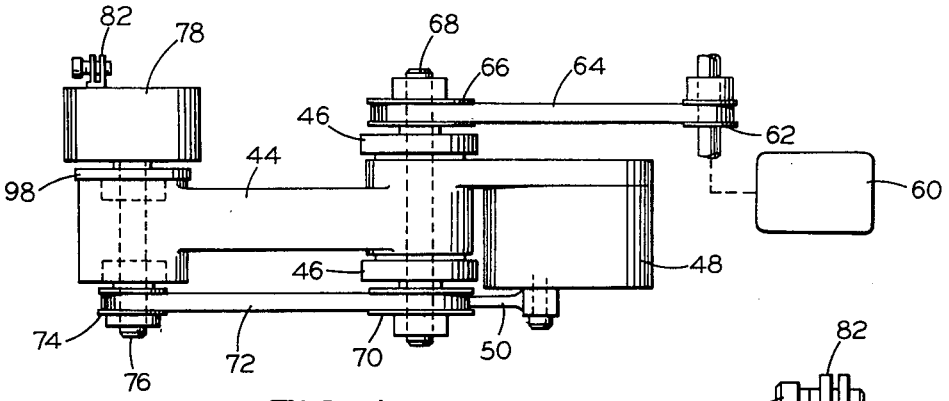
FIG. 4 is a top plan view of the blade drive mechanism on the cutting head.
Figure 2:
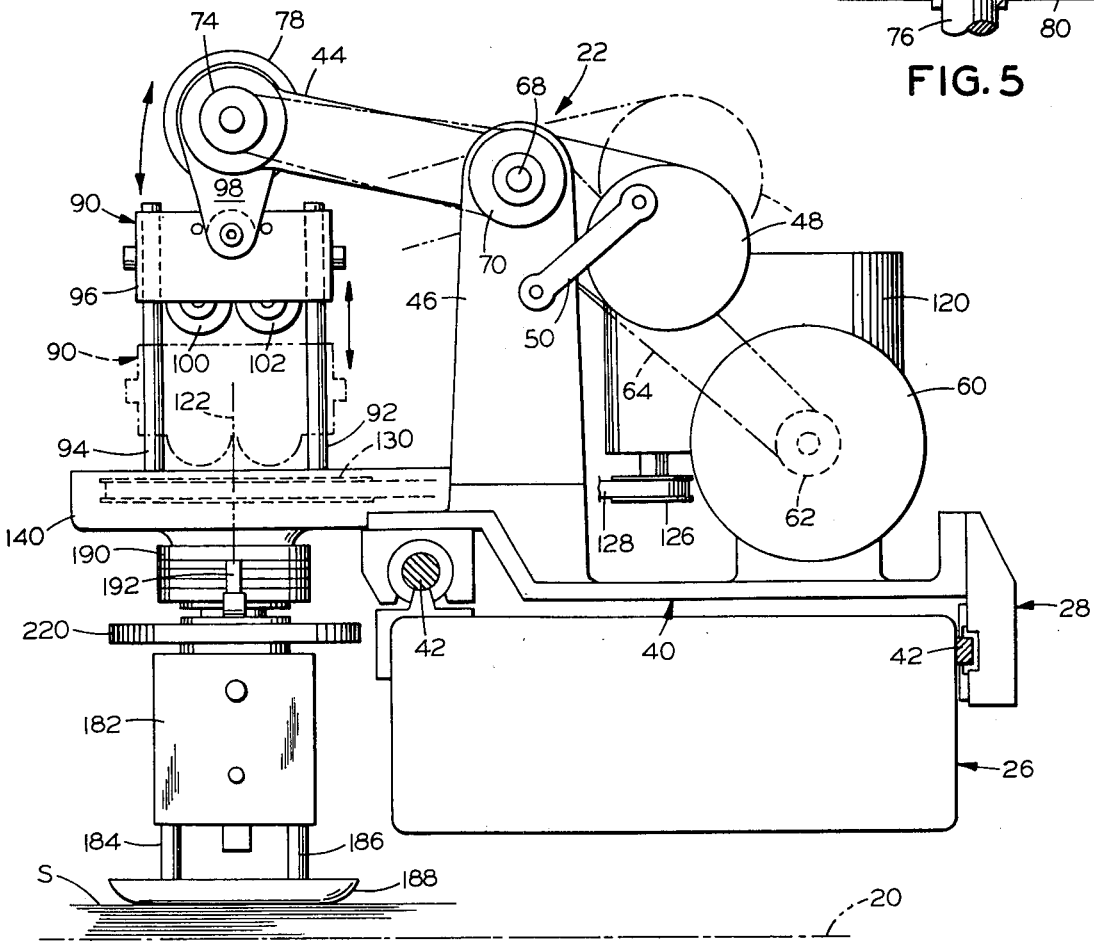
FIG. 2 is a side elevation view of the cutting head of the present invention mounted on the carriages of the cutting apparatus.
Figure 9:
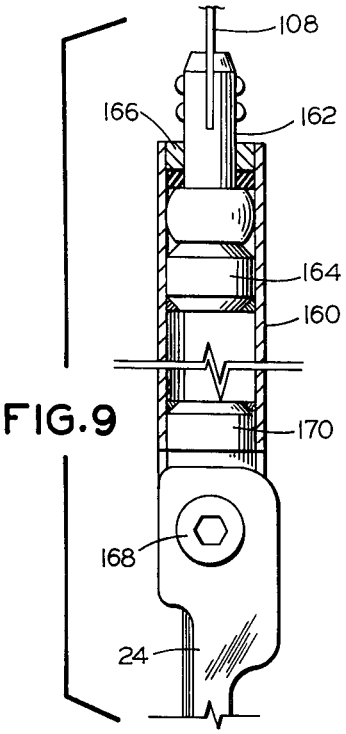
FIG. 9 is a fragmentary view of the drive linkage in FIG. 8 partially in section.

FIGS. 2, 3 and 4 illustrate in greater detail the features of the cutting head 22 mounted on the carriages 26 and 28. All of the components of the cutting head are supported on a mounting plate or platform 40 which may either be attached directly to or form a part of the Y-carriage 28 on ways 42. The cutting blade 24 is suspended from a pivotal mounting arm 44 which tilts relative to the support surface 20 of the cutting table on upright lugs 46 fixed to the mounted plate 40. Connected to the mounting arm 44 is a rotary solenoid 48 and a connecting rod 50 extending from the rotary output of the solenoid to the upright lugs 46. The rod 50 permits the solenoid 48 to move the arm 44 and correspondingly the cutting blade 24 between an upper position in which the blade is out of cutting engagement with sheet matlerial on the surface 20 and a lower position in which the blade is operated in cutting engagement with the sheet material.

A reciprocation drive motor 60 mounted on the plate 40 is connected in driving relationship with the blade 24 by means of a drive train through the pivot axis of the arm 44 and lugs 46. As seen in FIG. 4, the drive train is comprised of a pulley 62, a drive belt 64, a pulley 66, axle shaft 68, a pulley 70, a drive belt 72, a pulley 74, axle shaft 76 and an eccentric 78.

Figure 5:
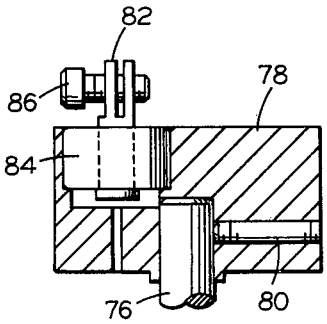
FIG. 5 is a fragmentary cross-sectional view of the eccentric in FIG. 4.
Figure 8:
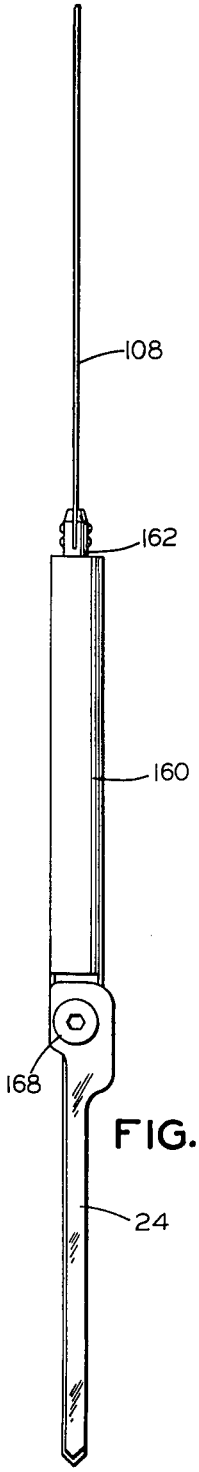
FIG. 8 is an assembly view of the reciprocating drive linkage connected to the cutting blade.

The eccentric 78 is shown in greater detail in FIG. 5. A set screw 80 holds the eccentric fixedly on the axle shaft 76 and a connecting crank pin 82 mounted by means of a bushing 84 in offset relationship to the shaft 76 includes a clamping screw 86 for attachment of the reciprocating blade linkage shown in detail in FIG. 8.

Figure 6:
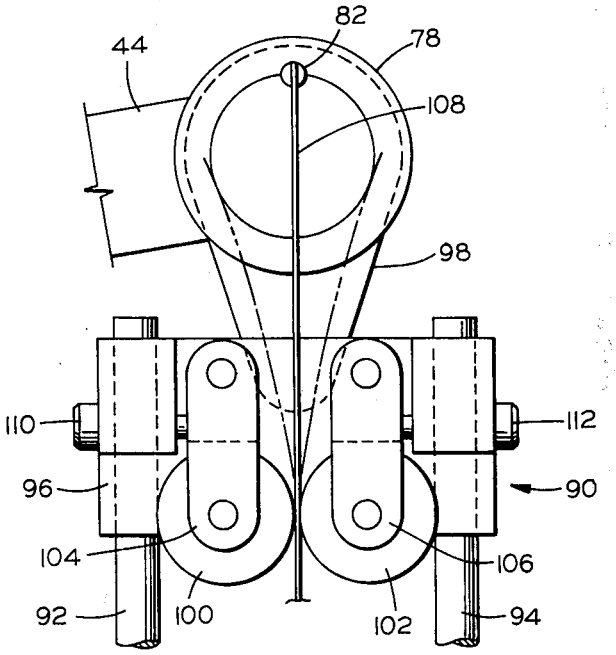
FIG. 6 is a fragmentary side elevation view of the eccentric in the drive mechanism and associated blade guide.

The reciprocating drive linkage between the eccentric 78 and the blade 24 passes through a guide assembly 90 illustrated in FIGS. 2 and 6. The guide assembly 90 is supported from the mounting plate on a pair of fixed slide rods 92 and 94 and includes a blade guide plate 96 which slides up and down on the rods 92 and 94 between the illustrated and phantom positions in FIG. 2. The up-and-down motion of the plate is caused by means of a connecting link 98 attached to the projecting end of the mounting arm 44 and, hence, corresponds to the lifting and plunging of the blade in and out of the sheet material. A pair of guide rollers 100, 102, are pendularly supported from the plate 96 by means of links 104 and 106, respectively, and are pressed by a pair of springs (not shown) against a flexible link 108 forming the upper portion of the reciprocating drive linkage to the blade. The compression of the springs can be varied by cap screws 110 and 112 to establish a centered position for the rollers 100 and 102.

It will be readily apparent that the flexible link 108 must bend between the limits illustrated in FIG. 6 as the connecting pin 82 is orbited in the eccentric 78. The guide rollers 100 and 102 establish a reference point through which the linear reciprocating motion of the cutting blade 24 takes place and the departure of the connecting pin 82 from points along the vertical axis through the reference point must be accommodated by the link 108. It will also be noted that the limited arcuate movement of the eccentric 78 is also accommodated by the link 108 as the mounting arm 44 tilts between its upper and lower positions.

Referring again to FIGS. 2 and 3, an orientation or $\theta$-drive motor 120 is shown mounted on the plate 40 adjacent the reciprocation drive motor 60. The cutting blade 24, as described in greater detail below, is suspended for rotation about a $\theta$-axis 122 in FIG. 2 perpendicular to the support surface 20 and the rotational position or orientation of the blade about the axis 122 is controlled by the $\theta$-drive motor 120 during a cutting operation so that the blade translates tangentially along cutting paths in the sheet material S. A drive train interconnecting the blade 24 and the motor 120 includes a toothed pulley 126 on the motor shaft, a toothed pulley 130 connected with the blade 24 as described in greater detail below, and a toothed belt interconnecting the pulleys 126 and 130. Like the X and Y position of the blade determined by the drive motors 30 and 32, the orientation of the blade must be precisely controlled; therefore, the toothed belt and pulley system is used and a feedback sensor (not shown) may also be connected to the $\theta$-drive motor 120 to supply position information to the control computer 14 in FIG. 1.

From the description so far, it will be understood that the cutting blade 24 is a reciprocating cutting blade that can be lifted in and out of cutting engagement with the sheet material S positioned on the cutting table 12. The blade 24 is translated along a cutting path in the sheet material by the X-carriage 26 and Y-carriage 28 and is maintained in tangential relationship with the cutting path by the $\theta$-drive motor 120. The cutting blade 24 may be continuously reciprocated as it is moved in and out of cutting engagement with the sheet material by virtue of the belt-pulley drive train extending from the motor 60 through the pivot axis of the support arm 44 to the eccentric 78 at the projecting end of the arm.

Figure 7:
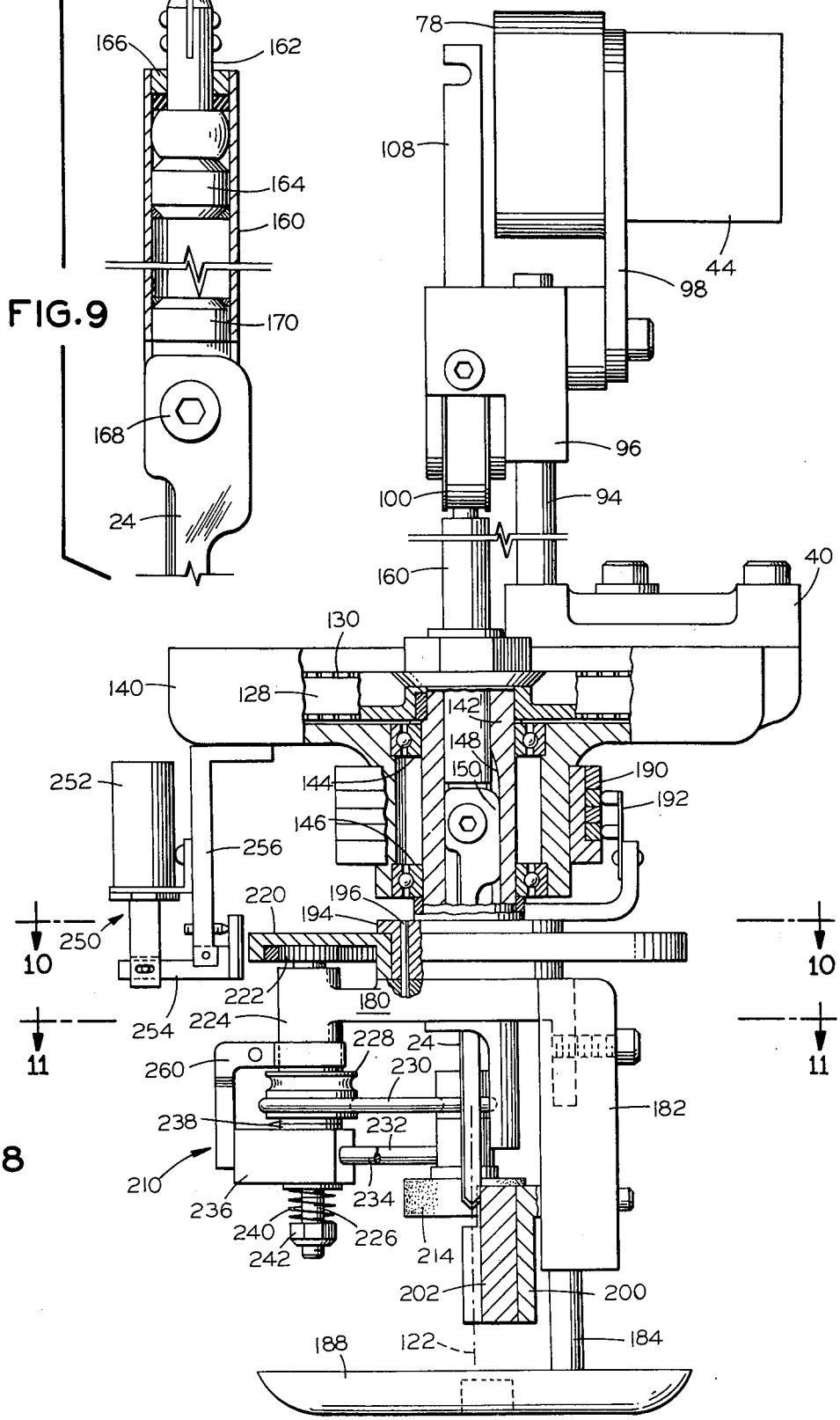
FIG. 7 is a side elevation view of the cutting head partially in section and includes one embodiment of the blade sharpener.

FIGS. 2 and 7 illustrate in detail the structure by which the cutting blade 22 is mounted for reciprocation, plunging and lifting and rotation relative to the mounting plate 40. A housing 140 is bolted to the mounting plate 40 in cantilever fashion and encloses the toothed pulley 130 which controls the rotation of the cutting blade 24. A hollow shaft or sleeve 142 is mounted for rotation about the $\theta$-axis in the housing 140 by means of roller bearings 144 and 146. The pulley 130 is keyed to the upper end of the sleeve 142 so that the sleeve rotates about the $\theta$-axis 122 in response to the control signals received by drive motor 120 in FIGS. 2 and 3. An internal groove 148 in the sleeve 142 receives a key or tang 150 at the trailing edge of the blade 24. The groove 148 extends axially along the sleeve 142 so that the tang 150 and groove 148 form a torque-transmitting, sliding connecton between the blade and the toothed pulley 130. Rotation of the pulley 130 about the $\theta$-axis 122 causes the blade 24 to rotate correspondingly while the reciprocating motion of the blade takes place in the bore of the sleeve 142. The blade 24, as illustrated in FIG. 7, is elevated out of contact with the sheet material, hence, the groove 148 has a length accommodating the plunging and lifting motions of the blade as well as the reciprocating motions during a cutting operation.

It will be understood that the flexible link 108 at the upper end of the reciprocating drive linkage cannot rotate about the $\theta$-axis 122 in view of the connection with the eccentric 78. Accordingly, the portion of the reciprocating drive linkage illustrated in FIG. 8 between the flexible link 108 and the blade 24 must accommodate the relative rotation of the blade and link in addition to transmitting the reciprocating motion between the same elements. The intermediate portion of the linkage is formed by a cylinder 160 having a swivelling end joint formed by a spherical bushing 162 at the upper end of the cylinder. The bushing 162 is connected to the flexible link 108 and is captured in the upper end of the cylinder 160 by a spacer 164 welded to the cylinder and a washer 166 fixed in the end of the cylinder. At the lower end of the cylinder the blade 24 is connected by a screw 168 to a slug 170 also welded in the cylinder. Accordingly, the flexible link 108 transmits reciprocating motions from the drive motor 60 to the blade 24 and the swivelling joint formed by spherical bushing 162 permits the blade to rotate about the $\theta$-axis 122 in response to the drive motor 120. Of course, the swivelling joint and flexible link 108 also cause the blade to plunge and lift in and out of cutting engagement with the sheet material.

At the lower end of the sleeve 142 in which the blade reciprocates, a flange plate 180 identified in FIG. 7 is fixedly secured so that the plate rotates about the $\theta$-axis 122 with the blade. Bolted to one side of the flange plate is a presser foot assembly comprises of a slide bracket 182, two slide rods 184, and 186 seen most clearly in FIG. 2 and a presser foot 188 which has a central cut-out or aperture through which the reciprocating blade 24 extends during a cutting operation. The slide rods 184 and 186 are fitted loosely within the bracket 182 so that the foot rests on the upper layer of the sheet material S under its own weight and prevents the material from lifting in a cutting operation during the upstroke of the blade.

It may be desirable to add a lifting solenoid to the presser foot assembly so that the foot may be automatically lifted off of the sheet material and held in an elevated position before and after a cutting operation. For this reason, a slip ring assembly comprised of stationary slip rings 190 and a rotating contact arm 192 are mounted on the cutting head. The assembly transmits control signals between the lower rotating portion of the head and the stationary upper portion attached to the mounting plate 40. The contact arm 192 is attached to a bushing 194 which in turn is fixed to the flange plate 180 by means of a pin 196 so that the bushing and contact arm are positively connected to the sleeve 142 and rotate about the $\theta$-axis 122 with the blade 24. Several sets of contact rings may be provided on the assembly to transmit information to or from other components on the rotating portion of the cutting head.

A lower blade guide 200 is also connected to the slide bracket 182 to support the lower end of the blade 24. The guide 200 has a slotted carbide insert which engages the sides and trailing edge of the cutting blade to prevent the blade from bending or twisting as it is forced along a cutting path through the sheet material.

With a relatively small blade 24 pointed at the lower end and supported in the cutting head with the central longitudinal blade axis and the $\theta$-axis substantially coincident, it is possible to drill holes in the sheet material for marking other purposes by plunging the blade into the sheet material at the point in the material where a hole is desired and spinning the blade in the material about the $\theta$-axis 122 with the $\theta$-drive motor 120. Such a drilling operation is possible because the blade has a narrow profile from the leading cutting edge to the trailing edge, a distance preferably in the order of ⅛ of an inch. It should be noted that the drilling operation can be performed with or without stopping the reciprocation of the blade. The blade should be stopped in the lower position of its stroke if it is stopped at all during the drilling operation. Maintaining the reciprocating motion eliminates the difficultly of stopping the blade at a particular position and also reduces the twisting forces on the blade.

Also, with a narrow blade such as shown, sharp turns in fabric sheet material can be executed while cutting without lifting and plunging the blade. The cutting program controlling and defining a cutting operation of this type is, accordingly, simplified.

A blade sharpener, generally designated 210 in FIG. 7 is suspended from the lower portion of the cutting head and, therefore, translates with the head to make blade sharpening available at any interval in a cutting operation. The sharpener 210 is comprised of a pair of abrasive sharpening wheels 212, 214 shown in FIG. 11 located adjacent each side of and slightly spaced from the leading cutting edge of the blade 24. During a sharpening operation the cutting wheels 212, 214 are swung alternately into contact with the blade 24 and are driven rotatably about their own axes by spinning the entire sharpener 210 and the blade 24 about the $\theta$-axis 122. To operate the sharpening wheels in this manner, a planetary drive train is employed.

As shown most clearly in FIGS. 7 and 10, a large ring gear 220 is mounted on the bushing 194 for rotation relative to the bushing and the sleeve 142 holding the blade 24, but normally the ring gear rotates with the blade during a cutting operation. A planetary gear 222 is rotatably mounted in an offset arm 224 of the flange plate 180 and engages the teeth of the ring gear 220. The planetary gear 222 is fixedly attached to the upper end of the rotatable drive shaft 226 and a double-grooved drive pulley 228 is fixedly to the mid-point of the shaft for rotation with the gear 222. A drive belt 230 formed by an elastomeric ring extends between the pulley 228 and the wheel 214 supported adjacent the blade 24 by means of a stand-off 232 shown most clearly in FIG. 11. Another drive belt (not shown) extends between the other groove in the pulley 228 to the wheel 212 supported on a stand-off 234 shown in FIG. 11.

Both the stand-offs 232 and 234 are anchored in a support block 236 which rotates freely on the lower end of the drive shaft 226. A friction coupling is formed between the block 236 and the drive pulley 228 by a pair of washers 238 and the friction force between the block and pulley can be varied by means of a pressure spring 240 manually adjusted by nut 242 below the block 236.

The blade sharpener 210 also includes a lock or brake assembly 250 suspended from the housing 140 and comprises of an electrically actuated solenoid 252 and a brake level 254. The brake lever 254 is suspended by a bracket 256 in closely spaced relationship with the peripheral surface of the ring gear 220. The lever 254 is pivotally connected to the bracket 256 and is connected to the armature of the solenoid 252 so that withdrawal of the armature into the housing of the solenoid pivots the brake lever on the bracket in a clockwise direction as viewed in FIG. 7 and brings the lever and ring gear 220 into braking or locking relationship. The ring gear 220 is then held fixed relative to the housing 140 and mounting plate 40.

With the brake assembly energized to hold the ring gear 220 fixed, rotation of the cutting blade 24 by means of the $\theta$-drive motor 120 causes the planetary gear 222, the drive pulley 228 and th sharpening wheels 212 and 214 to revolve about the $\theta$-axis 122 with the blade and, at the same time, imparts rotary motion to the sharpening wheels about their own axes. Also, the frictional coupling formed between the pulley 228 and support block 236 biases one or the other of the sharpening wheels into contact with the blade for sharpening the leading edge of the blade at one side. The precise sharpening wheel brought into contact with the blade depends upon the direction of rotation of the blade 24 and rotatable drive portion of the sharpener 210 by the motor 120 about the $\theta$-axis 122. Rotation in the clockwise direction as viewed in FIG. 11, for example, brings the sharpening wheel 212 into contact with the blade 24 and rotation in the counterclockwise direction brings sharpening wheel 214 into contact with the blade. By reciprocating the blade at the same time that the blade is rotated, the sharpening wheels will cover substantially the full extent of the cutting edge. The sharpening operation is performed when the blade is withdrawn from the sheet material since the spinning of the blade about the $\theta$-axis 122 by the drive motor 120 provides the motive forces for the sharpener 210.

The sharpening operation may be performed at periodic intervals in a cutting operation or whenever the accumulated cutting paths traversed by the blade exceed a predetermined length. When the sharpening operation is finished, the drive motor 120 is de-energized to stop the spinning of the blade 24 about the $\theta$-axis 122 and the solenoid 252 is de-energized to release the ring gear 220. A centering spring 260 then operates upon the support block 236 to move the cutting wheels 212 and 214 to a centered position about the blade 24 and out of contact with the leading, cutting edge.

Figure 13:
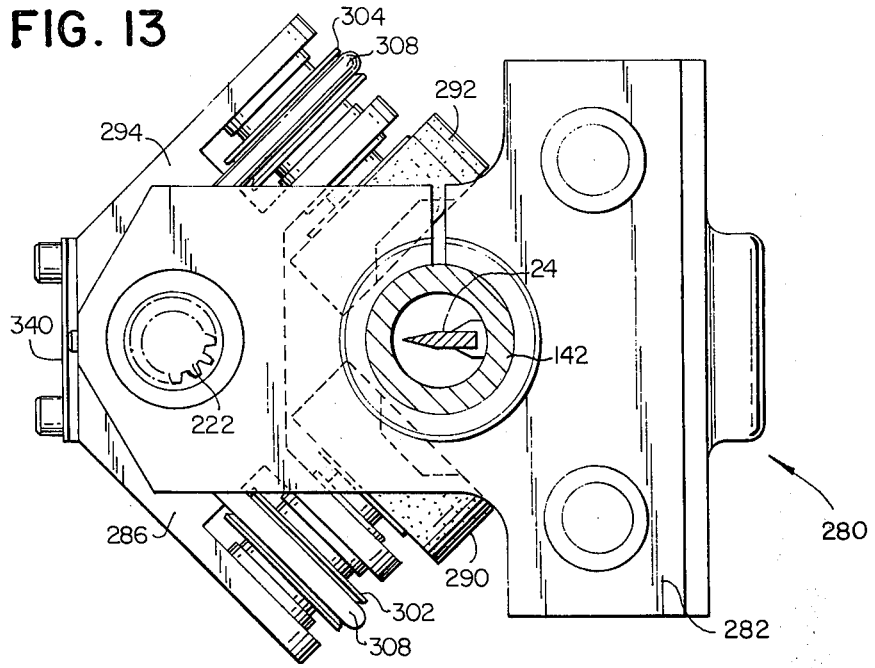
FIG. 13 is a top plan view of the sharpener in FIG. 12.
Figure 12:
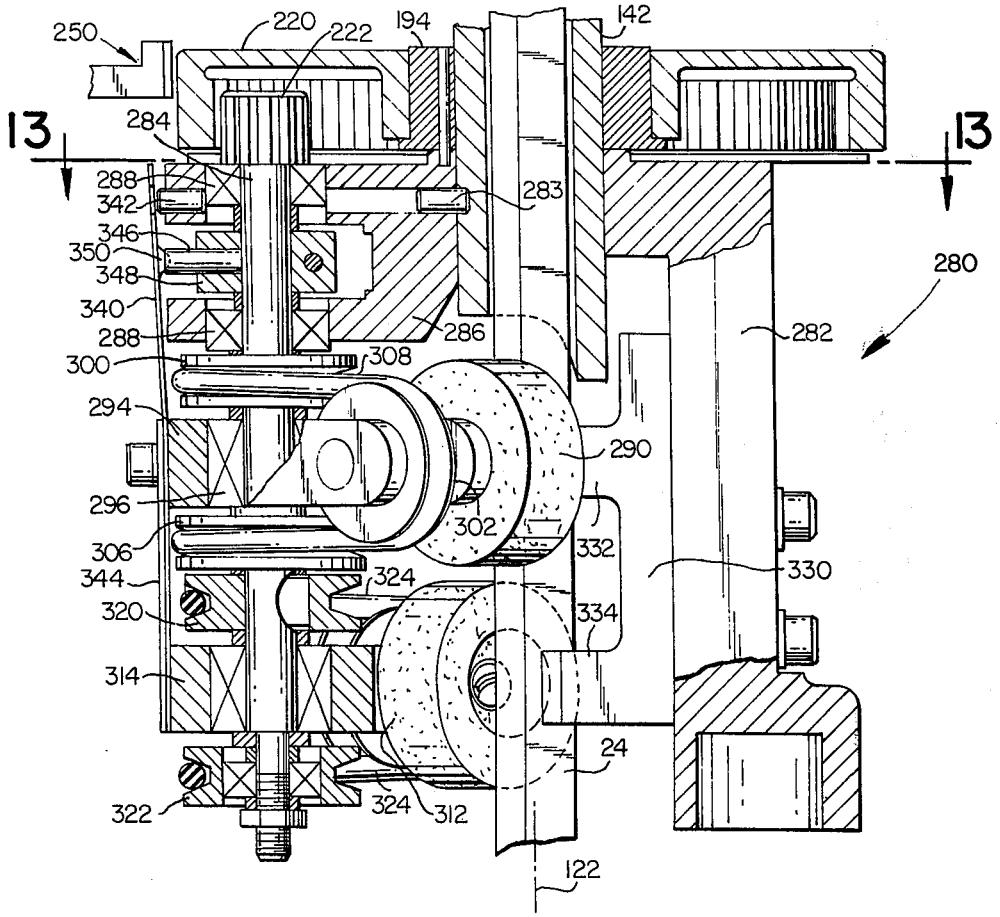
FIG. 12 is a sectional view of another embodiment of the blade sharpener.

Another embodiment of the blade sharpener, generally designated 280, is illustrated in detail in FIGS. 12 and 13. The blade sharpener 280 operates in substantially the same manner as the sharpener 210 in FIG. 7 and has substantially the same construction except that two pairs of sharpening wheels are suspended from the lower portion of the cutting head for rotation with the blade 24 about the $\theta$-axis 122 and the sharpener wheels are vertically arranged to rotate about the axes lying in planes perpendicular to the $\theta$-axis rather than parallel with the $\theta$-axis. With two pair of sharpening wheels oriented in vertical planes, a greater portion of the cutting edge on the blade 24 may be sharpened.

In the blade sharpener 280, a flange plate 282 is connected to the sleeve 142 by means of the dowel pin 283 so that the cutting blade 24 and the plate rotate about the $\theta$-axis together. The flange plate supports the planetary pinion gear 222 on the upper end of an extended drive shaft 284 for orbital movement about the $\theta$-axis with rotation of the blade. The extended drive shaft 284 is mounted by means of bearings 288 at the outer end of the flange plate arm 286 for rotation about the drive shaft axis relative to bifurcations of the arm.

As viewed most clearly in FIG. 13, an upper pair of sharpening wheels 290 and 292 are rotatably mounted in a Y-shaped yoke 294 on the drive shaft. The yoke is pivotally mounted on the drive shaft 284 by means of bearings 296 in FIG. 12, but is held at the illustrated axial station along the drive shaft by the bearings. Thus, the yoke is free to pivot on the drive shaft and swing the end face of one or the other of sharpening wheels 290 or 292 into engagement with the cutting edge of the blade 24 at one side or the other of the blade.

Driving forces for the sharpening wheels 290 and 292 are derived from the drive shaft 284 by means of drive pulleys 300, 302, 304 and 306 and a drive belt 308 formed by an elastomeric ring extending around all of the pulleys. The drive pulley 300 is keyed to the drive shaft but the drive pulley 306 is freely rotated on the drive shaft since it must rotate in a direction opposite that of the shaft and pulley 300. The drive pulleys 302 and 304 are ridigly and thus drivingly connected with the sharpening wheels 290 and 292 respectively to provide the desired rotation.

As shown in FIG. 12, a sharpening wheel 312 is suspended below the sharpening wheel 292 by means of another Y-shaped yoke 314. The yoke 314 like the yoke 294 is pivotally mounted on the lower end of the drive shaft 284 by means of bearings 316 and is also held at the illustrated axial station along the shaft by the bearings. Another sharpening wheel (not shown) is mounted on the yoke 314 directly under the wheel 290 so that two pair of sharpening wheels, one pair suspended below the other, are provided for sharpening different portions of the cutting blade as it reciprocates.

The drive mechanism between the shaft 284 and the lower pair of sharpening wheels is similar to that between the shaft and the upper pair of sharpening wheels. The mechanism includes drive pulleys 320 and 322 on the drive shaft, and two additional drive pulleys (not shown) supported in the respective ends of the yoke and connected with the lower pair of sharpening wheels in the same manner as the drive pulleys 302 and 304 connect with the upper pair of sharpening wheels. A drive belt 324 interconnects all of the pulleys associated with the lower sharpening wheels and is driven by means of the pulley 320 fixed to the drive shaft 284 in the same manner as the pulley 300. The pulley 322 rotates freely on the lower end of the drive shaft in the manner of pulley 306.

In operating the sharpener 280, the brake assembly 250 engages the ring gear 220 while the sleeve 142, the cutting blade 24 and the lower portion of the sharpening apparatus are rotated about the $\theta$-axis 122. While the ring gear slips on the bushing 194 due to the brake assembly 250, the planetary gear 222 rotates and in turn drives both the upper and lower pairs of sharpening wheels. As $\theta$-rotation is initiated, the inertial restraint of the yokes 294 and 314 and the sharpening wheels causes one of the sharpening wheels on each yoke to swing about the drive shaft into engagement with one side of the cutting blade 24 along the leading, cutting edge. With the yokes and sharpening wheels swung out of the centered position of FIGS. 12 and 13, centrifugal forces developed on these components hold the two wheels in engagement with the blade. By reciprocating the blade as it is rotated about the $\theta$-axis 122, the full extent of the cutting edge along a large segment of the cutting blade is sharpened. When the direction of rotation of the blade and the sharpening apparatus about the $\theta$-axis 122 is reversed, the opposite sharpening wheel on each yoke is brought into and held in engagement with the cutting edge on the opposite side of the blade.

It will be observed in FIG. 12 that a carbide blade support 330 is connected to the lower portion of the flange plate 282 and has two outwardly projecting blade guides 332 and 334 which hold the blade along the $\theta$-axis. To avoid interference between the blade guides and the sharpening wheels, the end faces of the wheels which engage the cutting edge are recessed at their centers and the blade guides are dimensioned so that they fit within the recess when the blade and wheels are in engagement. Thus, the blade is held relatively rigid along the $\theta$-axis without bending due to the side loads applied to the blade by the sharpening wheels.

It is desirable to slightly tilt the lower pair of sharpening wheels by, for example, an angle of 1° so that the lower portion of each wheel tends to bear more heavily against the cantilevered portion of the blade below the lower blade guide 334. Since the lower portion of the blade is free to deflect slightly against the forces of the sharpening wheel a lighter pressure between the wheel and the blade would be developed. By tilting the sharpening wheels slightly, the cutting edge of the blade and the end faces of the wheels are brought into parallel relationship. Also, the upper portions of the lower wheels bear less heavily against the blade; however, this too is desirable since it relieves some of the sharpening action on the midportion of the cutting blade which is reciprocated into engagement with both the upper and lower cutting wheels. Thus, excessive wear on the midportion of the blade is reduced.

To hold the yokes 294 and 314 and the two pairs of sharpening wheels in the centered position out of engagement with the blade 24 during cutting operations, a leaf spring 340 is bolted to the upper yoke 294 and has an aperture in its upper end which engages a pin or detent 342 fixed in the arm 286 of the flange plate 282. The lower end of the leaf spring is held in contact with a flat on the lower yoke 314 by means of a stiffener 344 so that in general the upper and lower yokes are coupled together and are held in generally the same position. The lower end of the leaf spring and stiffener could be bolted to the yoke 314; however, the pressure contact developed without bolts allows slightly different angular positions of the yokes to exist in situations where the sharpening wheels on the upper and lower yokes have incurred different degrees of wear and therefore have different thickness.

During a sharpening operation, the upper end of the leaf spring 340 is disengaged from the detent 342 by means of a tang 346 attached to the drive shaft 284 by means of a clamp 348. The tang rotates with the drive shaft as a sharpening operation is initiated and engages a dimple 350 in the leaf spring below the detent 342 to lift the spring out of engagement with the detent. The yokes are then unlocked and free to pivot away from the centered position. Additionally, the tang pushes on the dimple and initiates a slight pivoting movement of the yokes 294 and 314 away from the centered position which reinforces the similarly directed inertial forces. As the inerital and centrifugal forces move the yokes out of the centered position and bring one of the upper sharpening wheels and one of the lower sharpening wheels into engagement with the cutting blade 24, the aperture in the upper end of the leaf spring 340 moves out of alignment with the detent 342.

When the directional of rotation about the $\theta$-axis 122 is reversed during sharpening, the rotation of the tang 246 reverses and strikes the dimple 350 from the opposite direction which also reinforces the reversed inertial forces that swing the yokes 294 and 314 in the opposite direction and bring the other two sharpening wheels into engagement with the opposite side of the cutting blade 24.

When a sharpening operation is complete, the yokes and sharpening wheels may not lock in the centered position until the motions of the cutting blade swing the aperture in the leaf spring back into registration with the detent 342. If the tang 346 happens to stop in the position illustrated, the swinging motion of the wheels and the dimple tend to push the tang out of the illustrated position so that the detent and aperture in the upper end of the leaf spring may again engage.

While the present invention has been described in a preferred embodiment, it will be understood that numerous modifications and substitutions can be had to the specific structure and methods disclosed without departing from the spirit of the invention. It is apparent that the pair of vertically oriented sharpening wheels 290 and 292 may be utilized without an additional pair of wheels suspended below. Also, the centering spring 260 as shown in FIG. 7 may be used in the embodiment of the sharpener shown in FIG. 12. Conversely, the centering spring 340 utilized in the embodiment of FIG. 12 may be utilized in the embodiment of FIG. 7. The ratios of the drive gears and the sizes of the sharpening wheels may be suitably adjusted to obtain a selected sharpening speed for the reciprocation rate of the cutting blade. Accordingly, the present invention has been described in a preferred embodiment by way of illustration rather than limitation.

I claim:

1. A blade sharpener for a cutting apparatus with a cutting blade having a cutting edge and a blade support rotated by an orientation drive motor about an axis perpendicular to a work supporting planar surface to orient the blade in a cutting operation in a selected cutting direction comprising:

a sharpening wheel suspended from the blade support and adjacent the cutting edge of the blade for rotation about the perpendicular axis with the blade; and drive means having an output member connected with the sharpening wheel and selectively engageable with the orientation drive motor which orients the blade to rotate the output member and drive the wheel about the wheel axis in conjunction with the rotation of the blade and blade support about the perpendicular axis.

2. A blade sharpener for a cutting apparatus as defined in claim 1 wherein:

the drive means comprises a planetary drive mounted on the blade support and selectively operated locking means cooperating with a portion of the planetary drive to cause the output member to selectively rotate simultaneously with the blade support.

3. The blade sharpener of claim 2 wherein:

the planetary drive includes a ring gear mounted on the blade support coaxially of the perpendicular axis and a planet gear mounted on the blade support and engaging the ring gear; and the locking means cooperates with one of the gears to selectively prevent the one of the gears from rotating about the perpendicular axis with the blade and blade support whereby the other of the gears is driven.

4. The blade sharpener of claim 3 wherein:

the locking means cooperates with the ring gear to prevent rotation of the ring gear about the perpendicular axis with the blade;

the planet gear is mounted in offset relationship to the perpendicular axis and for rotation about the axis with the blade whereby the planet gear is driven by the ring gear; and the output member of the planetary drive is an output shaft driven by the planet gear.

5. The blade sharpener of claim 4 wherein:

the sharpening wheel is supported in offset relationship from the output shaft by means of a stand-off; and a frictional coupling is provided for producing a biasing force urging the stand-off and the wheel toward the cutting edge of the blade with the locking means prevents ring gear rotation.

6. The blade sharpener of claim 5 wherein the frictional coupling is an adjustable frictional coupling.

7. The blade sharpener for a cutting apparatus as defined in claim 1 wherein:

the sharpening wheel is one of two sharpening wheels suspended from the blade support for rotation about the perpendicular axis, the wheels being suspended respectively adjacent each side of the cutting edge of the cutting blade; and the drive means is connected in driving relationship with each of the two sharpening wheels.

8. The blade sharpener of claim 7 wherein:

the drive means additionally produces biasing forces on the two cutting wheels urging the wheels into contact with the cutting edge of the blade.

9. The blade sharpener of claim 7 wherein:

the drive means produces directional biasing forces urging one or the other of the wheels into contact with the cutting edge of the blade, the direction of the biasing force being independent upon the direction of rotation of the blade and blade support about the perpendicular axis by the drive motor.

10. The blade sharpener of claim 9 further including:

centering means connected between the two sharpening wheels and the blade support for holding the wheels at a centered position with respect to the blade.

11. A blade sharpener for a cutting apparatus as defined in claim 10 wherein the centering means comprises a leaf spring extending between the two sharpening wheels and the blade support and a detent engageable with one end of the leaf spring to lock the wheels and the support together at the centered position with respect to the blade.

12. A blade sharpener for a cutting apparatus as defined in claim 11 further including a tang mounted for rotation on the output member and engageable with the leaf spring.

13. A blade sharpener for a cutting apparatus as defined in claim 1 wherein:

another sharpening wheel is suspended from the blade support adjacent the blade for rotation about the perpendicular axis with the blade, the two sharpening wheels being suspended one below the other for engagement with different portions of the cutting blade along one edge; and the output member of the drive means is connected with each of the wheels for rotating the wheels about the respective wheel axes in response to rotation of the blade and blade support about the perpendicular axis.

14. A blade sharpener for a cutting apparatus as defined in claim 13 wherein the two wheel axis of the sharpening wheels are located in planes substantially perpendicular to said perpendicular axis about which the blade rotates.

15. A blade sharpener for a cutting apparatus as defined in claim 14 wherein the wheel axis of the lower wheel is slightly tilted to cause the bottom portion of the lower wheel to tend to bear more heavily against the blade.

16. A blade sharpener as defined in claim 13 still further including two sharpening wheels suspended one below the other from the blade support for engagement with the blade and located respectively at one side of the blade opposite the other two sharpening wheels for sharpening the cutting blade on each side.

17. A blade sharpener as defined in claim 1 wherein another sharpening wheel is suspended from the blade support, the two wheels being held in a yoke and on opposite sides of the cutting blade, and the yoke is suspended from the blade support for rotation about the perpendicular axis with the blade and is free to pivot relative to the blade about another axis offset and parallel to the perpendicular axis.

18. In combination with a cutting apparatus having a reciprocated cutting blade suspended from a platform for rotation about a blade axis parallel to the direction of reciprocation, a blade sharpener comprising:

a yoke suspended from the platform for rotation with the blade about the blade axis and pivotable about an orbital axis parallel to and offset from the blade axis;

two sharpening wheels mounted on the yoke and located in a centered position of the yoke on opposite sides of the cutting blade respectively to swing with pivoting motions of the yoke about the orbital axis into engagement with the cutting blade on one side or the other; and drive means connected with the sharpening wheels for rotating the wheels about their own axes in engagement with the cutting edge of the blade, the drive means comprising a planetary drive means having two gears, one of the gears being a planetary gear mounted for orbital movement about the blade axis with blade rotations and the other gear being a ring gear engaged with the planetary gear and selectively coupled in stationary relationship to the platform during a sharpening operation to drive the planetary gear.

19. The blade sharpener of claim 18 wherein:

the drive means further includes a drive shaft on which the orbited planetary gear is mounted for orbiting movement about the blade axis, the drive shaft being coaxial with the orbital axis; and the yoke is pivotally mounted on the drive shaft.

* * * * *

UNITED STATES PATENT OFFICE

CERTIFICATE OF CORRECTION

Patent No. 4,033,214 Dated July 5, 1977

Inventor(s) David Raymond Pearl

It is certified that error appears in the above-identified patent and that said Letters Patent are hereby corrected as shown below:

Column 2, lines 57 and 58, after "the" delete --cutting table 12 and a control computer 14 which controls the--.

Column 3, line 56, "matlerial" should be --material--.

Column 5, line 59, "comprises" should be --comprised--.

Column 7, line 4, "fixedly" should be --fixed--.

Column 7, line 23, "comprises" should be --comprised--.

Column 7, line 38, "th" should be --the-- (second occurence).

Column 10, line 10, "thickness" should be --thicknesses--.

Column 10, line 29, "directional" should be --direction--.

Column 10, line 31, "246" should be --346--.

Column 11, line 68, "independent" should be --dependent--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*